United States Patent [19]

Adrian et al.

[11] Patent Number: 4,690,264

[45] Date of Patent: Sep. 1, 1987

[54] MULTIFUNCTION GLASSHOLDER FOR ESCALATOR BALUSTRADE

[75] Inventors: Willy Adrian, Obernkirchen; Gerald Wente, Pohle, both of Fed. Rep. of Germany

[73] Assignee: Otis Elevator Company, Farmington, Conn.

[21] Appl. No.: 846,396

[22] Filed: Mar. 31, 1986

[51] Int. Cl.[4] ..... B66B 9/14

[52] U.S. Cl. ..... 198/335

[58] Field of Search ..... 198/333, 335; 256/24; 52/397, 403, 489, 716

[56] References Cited

U.S. PATENT DOCUMENTS

| | | | |
|---|---|---|---|
| 3,321,059 | 5/1967 | Kroepel | 198/335 |
| 3,989,133 | 11/1976 | Courson et al. | 198/335 |
| 3,991,877 | 11/1976 | Kraft et al. | 198/335 |
| 4,159,758 | 7/1979 | Courson | 198/335 |
| 4,488,631 | 12/1984 | Courson | 198/335 |

FOREIGN PATENT DOCUMENTS

| | | | |
|---|---|---|---|
| 1512084 | 2/1968 | France | 198/335 |
| 0039273 | 3/1977 | Japan | 198/335 |
| 0013786 | 2/1978 | Japan | 198/335 |
| 0040988 | 4/1978 | Japan | 198/335 |
| 2110625 | 6/1983 | United Kingdom | 198/335 |

*Primary Examiner*—Joseph E. Valenza
*Assistant Examiner*—D. Glenn Dayoan
*Attorney, Agent, or Firm*—Gerald E. Linden

[57] ABSTRACT

A glassholder (10) secures the balustrade (16) of an escalator to the truss (12) thereof; and also serves to secure the inward decking profile (40), the outward decking profile (42), and the exterior cladding profile (44) with relationship to the truss (12).

3 Claims, 2 Drawing Figures

MULTIFUNCTION GLASSHOLDER FOR ESCALATOR BALUSTRADE

TECHNICAL FIELD OF THE INVENTION

The invention relates to the securement of glass escalator balustrades.

BACKGROUND OF THE INVENTION

Space and serviceability are important considerations in escalator design. There are many components that need to be secured, one of the most visible of which is the balustrade. Modern escalators use glass balustrades.

DISCLOSURE OF THE INVENTION

Therefore, it is an object of this invention to provide a glassholder that is easily accessible for service and that performs other clamping/holding functions.

According to the invention, a glassholder secures the balustrade of an escalator to the truss thereof; and also serves to secure the inward decking profile, the outward decking profile, and the exterior cladding profile with relationship to the truss.

Other objects, features and advantages of the application will become more apparent in light of the following description thereof.

BEST MODE FOR CARRYING OUT THE INVENTION

Figure 1:
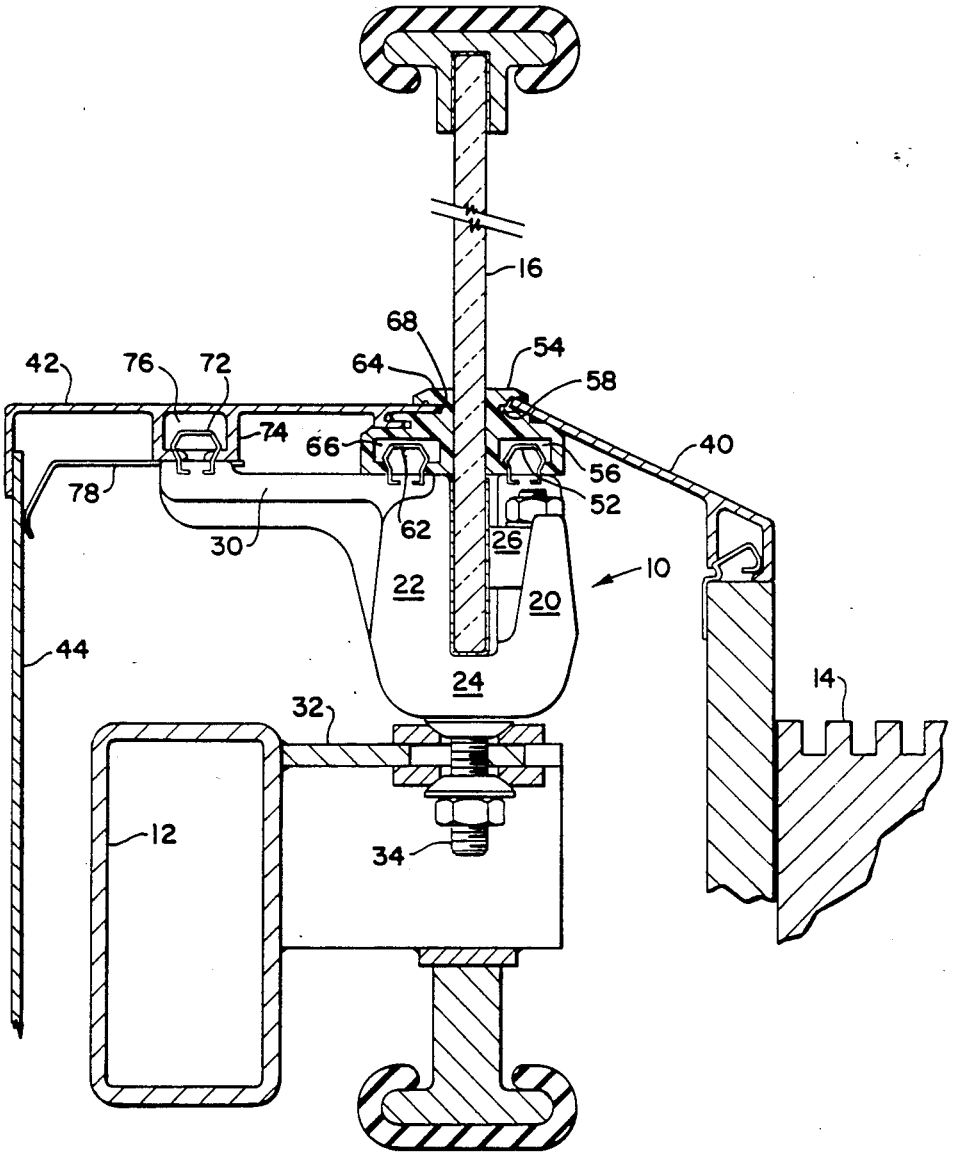
FIG. 1 is a longitudinal cross-sectional view of one side of an escalator showing the glassholder of this invention.
Figure 2:
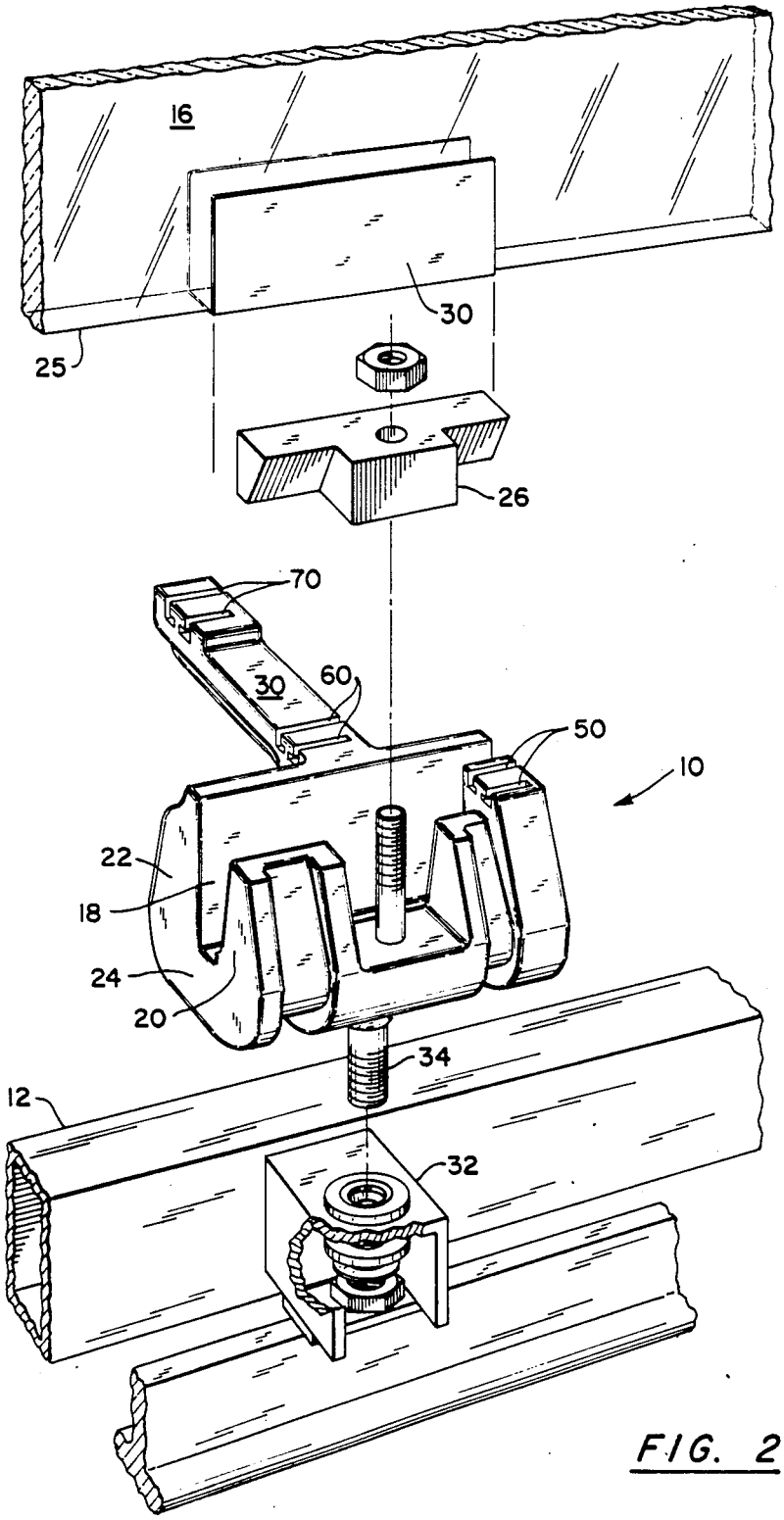
FIG. 2 is an isolated perspective view of the glassholder.

FIG. 1 shows the glassholder 10 of this invention in relationship to other major escalator components; a truss 12, a step 14 and a balustrate 16. The primary function of the glassholder is to anchor the glass balustrade to the truss.

The following terms are used in this description:

Horizontal—meaning across the page of FIG. 1, or parallel to the tread surface of the step 14;

Vertical—meaning up/down the page of FIG. 1, or perpendicular to the tread surface of the step 14;

Longitudinal—meaning into the page of FIG. 1 at an angle with the vertical corresponding to the direction of travel of the escalator, or along the truss 12;

Inward—meaning towards the step 14;

Outward—meaning away from the step 14;

Upward—meaning towards the top of FIG. 1.

Downward—meaning towards the bottom of FIG. 1.

The balustrade 16 is a sheet of glass, having a horizontal thickness and extending vertically-by-longitudinally.

The truss 12 is a longitudinally-extending box structure, having a rectangular cross-section aligned horizontally-by-vertically.

The glassholder 10 has a U-shaped cross section. A channel 18 formed thereby extends longitudinally. An inward leg 20 and an outward leg 22 of the glassholder 10 extend upwardly from a base portion 24. The downward portion of the balustrade 16 fits within the channel 18, and is clamped firmly therein by a wedge arrangement 26 disposed in the inward leg 20 of the glassholder 10.

What has been described so far is fairly typical of the prior art. The novel features of this invention will now be discussed.

In addition to the U-shaped cross section, the glassholder 10 is provided with an arm 30 that extends outwardly from the upward portion of the outward leg 22 to a position above the truss 12.

The truss 12 is provided with a bracket 32 that extends inwardly from the upward portion of the truss 12 to a position below the base portion 24 of the glassholder 10. A bolt 34 extends downwardly from the base portion 24 of the glassholder 10 for securing the glassholder 10 to the inward end of the bracket 32.

The glassholder 10 of this invention serves functions other than securing the balustrade 16. As described hereinafter, the glassholder 10 also secures the following escalator components to the truss 12:

inward decking profile 40, which is a flat panel extending inwardly and downwardly from the balustrade 16 towards the step 14;

outward decking profile 42, which is a flat panel extending outwardly from the balustrade 16, from a point opposite the outward end of the inward decking profile 40; and exterior cladding profile 44, which is a flat panel extending downwardly from the outward end of the outward decking profile 42.

The outward edge of the inward decking profile 40 is secured to the glassholder 10 in the following manner. A pair of slots 50 are disposed in the upward surface of the inward leg 20 of the glassholder 10. These slots 50 captivate the downward-facing ends of a U-shaped clip 52 so that the main body of the clip 52 extends upwardly out of the surface of the glassholder 10. A plastic piece 54 has a flat downward surface with a recess 56 disposed therein for snap-fitting to the clip 52. The piece 54 has a flat outward surface extending upwardly from the outward edge of the downward surface, and this outward surface abuts the balustrade 16. A longitudinal slot 58 is disposed in the piece 54 and is oriented to receive the outward edge of the inward decking profile 40.

The inward edge of the outward decking profile 42 is secured to the glassholder 10 in the following manner. A pair of slots 60 are disposed in the upward surface of the outward leg 22 (or, equivalently, in the upward surface of the inward end of the arm 30) of the glassholder 10. These slots 60 captivate the downward-facing ends of a U-shaped clip 62 so that the main body of the clip 62 extends upwardly out of the surface of the glassholder 10. A plastic piece 64 has a flat downward surface with a recess 66 disposed therein for snap-fitting to the clip 62. The piece 64 extends longitudinally. The piece 64 has a flat inward surface extending upwardly from the inward edge of the downward surface, and this inward surface abuts the balustrade 16. A longitudinal/-horizontal slot 68 is disposed in the piece 64 to receive the inward edge of the outward decking profile 42.

A pair of slots 70 are disposed in the upward surface of the outward end of the arm 30. These slots 70 captivate the downward-facing ends of a U-shaped clip 72 so that the main body of the clip 72 extends upwardly out of the surface of the glassholder 10. A longitudinal channel 74 is formed midway between the inward and outward edges of the outward decking profile 42. The channel 74 has a recess 76 disposed therein for snap-fitting to the clip 72.

A flat spring clip 78 extends horizontally outwardly from the upward surface of the arm 30, and thence downwardly and outwardly, to secure the exterior cladding profile 44 in the following manner. The outward edge of the outward decking profile is bent down vertically to form a stop against which the upward edge of the exterior cladding profile 44 is held in place by the outward force of the spring clip 78.

We claim:

1. An escalator comprising a truss (12), a balustrade (16) disposed inward of the truss (12), a step (14) disposed inward of the balustrade (16), a glassholder (10) attaching the balustrade (16) to the truss (12), an inward decking profile (40) extending inwardly and downwardly from the balustrade (16) towards the step (14), an outward decking profile (42) extending outwardly from the balustrade from a point opposite the outward edge of the inward decking profile (40), and an exterior cladding profile (44) extending downwardly from the outward edge of the outward decking profile (42), characterized in that:

the glassholder (10) has a base portion (24), an upwardly-extending inward leg (20) and an upwardly-extending outward leg (22), thereby forming a U-shaped longitudinal channel (18) for receiving the base portion of balustrade;

the glassholder (10) has clamping means (26) disposed in the inward leg (20) for securing the balustrade (16) in the glassholder (10);

the truss (12) has a bracket (32) extending inwardly therefrom to a position below the base portion (24) of the glassholder;

the glassholder (10) is attached by its base portion (24) to the bracket (32);

a first piece (54) abutting one side of the balustrade (16) and containing a slot to receive the edge of the inner decking profile (40);

the glassholder (10) has a spring clip (52) disposed in the upward surface of the inward leg (20) that extends into a slot 56 in the first piece (54);

a second piece (64) abutting one side of the balustrade (16) and containing a slot for receiving the edge of the outer decking profile (42);

the glassholder (10) has a spring clip (62) disposed in the upward surface of the outward leg (22) that extends into a slot in said second piece.

2. Escalator according to claim 1, characterized in that:

the glassholder (10) has an arm (30) extending outwardly from the upward portion of the outward leg (22) to a position above the truss (12);

the glassholder (10) has a clip (72) disposed in the upward surface of the outward end of the arm (30) for securing a midportion of the outward decking profile (42).

3. Escalator according to claim 2, characterized in that:

the outward edge of the outward decking profile (42) is bent down vertically to form a stop against which the upward edge of the exterior cladding profile (44) may be held outwardly in place; and the glassholder (10) has a clip (78) extending outwardly from the arm (30) and urging the upward edge of the exterior cladding profile (44) against the stop formed by the outward decking profile (42).

* * * * *